US008640399B2

(12) United States Patent
Fradera Pellicer

(10) Patent No.: US 8,640,399 B2
(45) Date of Patent: Feb. 4, 2014

(54) CEMENT MORTAR PANEL WITH PRESTRESSED BIAXIAL REINFORCEMENT

(76) Inventor: Carlos Fradera Pellicer, L'Aldosa—La Massana (AD)

( * ) Notice: Subject to any disclaimer, the term of this patent is extended or adjusted under 35 U.S.C. 154(b) by 737 days.

(21) Appl. No.: 12/600,165

(22) PCT Filed: Dec. 3, 2007

(86) PCT No.: PCT/ES2007/000706
§ 371 (c)(1),
(2), (4) Date: Sep. 3, 2010

(87) PCT Pub. No.: WO2008/139003
PCT Pub. Date: Nov. 20, 2008

(65) Prior Publication Data

US 2011/0011024 A1 Jan. 20, 2011

(30) Foreign Application Priority Data

May 14, 2007 (ES) ..... 200700993 U
Oct. 11, 2007 (ES) ..... 200702060 U

(51) Int. Cl.
*E04B 2/42* (2006.01)
*E04B 2/44* (2006.01)
*E04B 1/41* (2006.01)
*E04G 21/02* (2006.01)

(52) U.S. Cl.
USPC ..... 52/125.1; 52/124.2; 52/125.4; 52/125.5; 52/506.06; 52/506.05

(58) Field of Classification Search
USPC ..... 52/125.1, 124.2, 125.2, 125.4, 125.5, 52/506.06, 506.05, 511, 682, 686, 414
See application file for complete search history.

(56) References Cited

U.S. PATENT DOCUMENTS 2,772,560 A * 12/1956 Neptune ..... 52/707
3,195,278 A * 7/1965 Ballou ..... 52/705
3,236,019 A * 2/1966 Ballou ..... 52/705
3,476,912 A * 11/1969 Garrison ..... 219/213
3,913,287 A * 10/1975 Chapman, Jr. ..... 52/94
3,943,676 A 3/1976 Ickes
4,069,629 A * 1/1978 Piazza ..... 52/125.5

(Continued)

FOREIGN PATENT DOCUMENTS

ES 2 217 948 A1 1/2004
ES 2 220 189 A1 12/2004

(Continued)

OTHER PUBLICATIONS

International Search Report issued in connection with International Application No. PCT/ES2007/000706 and completed on Apr. 16, 2008.

*Primary Examiner* — Phi A
(74) *Attorney, Agent, or Firm* — Alston & Bird LLP

(57) ABSTRACT

This cement mortar panel with prestressed biaxial reinforcement is formed by a slab of cement mortar which, having a thickness ranging from 2 to 7 cms, includes a biaxial reinforcement. The slab has occluded in the cement mortar mass means for versatile operating on the panel assembly allowing for its handling and/or fixation to a building structure, which versatile operating means constitute of themselves, on one part, means for retaining them in the set mass of cement mortar and, on another part opposite to the former, anchoring means either for panel handling members or members for its fixation to the building structure.

11 Claims, 8 Drawing Sheets

(56) References Cited

U.S. PATENT DOCUMENTS

| | | | | | |
|---|---|---|---|---|---|
| 4,233,787 | A | * | 11/1980 | Piazza | 52/125.5 |
| 4,615,554 | A | * | 10/1986 | Schilla et al. | 294/89 |
| 4,676,035 | A | * | 6/1987 | GangaRao | 52/125.5 |
| 4,741,141 | A | * | 5/1988 | Harke | 52/506.06 |
| 4,925,331 | A | * | 5/1990 | Bertsche | 403/267 |
| 5,119,606 | A | * | 6/1992 | Graham | 52/125.4 |
| 5,138,813 | A | | 8/1992 | Cooney et al. | |
| 5,239,798 | A | | 8/1993 | Saito | |
| 5,419,091 | A | * | 5/1995 | Roberts | 52/509 |
| 7,435,038 | B2 | * | 10/2008 | Peterson | 405/230 |
| 7,905,068 | B2 | * | 3/2011 | Waters, Jr. | 52/301 |
| 8,122,650 | B2 | * | 2/2012 | Eickhof | 52/134 |
| 8,468,765 | B1 | * | 6/2013 | Kim | 52/506.06 |
| 2002/0059768 | A1 | | 5/2002 | Blount | |

FOREIGN PATENT DOCUMENTS

| | | | |
|---|---|---|---|
| FR | 1487943 | | 7/1967 |
| GB | 2 196 038 | A | 4/1988 |
| JP | 2098406 | A | 4/1990 |
| JP | 7048162 | A | 2/1995 |
| JP | 7259332 | A | 10/1995 |
| JP | 10072872 | A | 3/1998 |
| JP | 2000052331 | A | 2/2000 |
| JP | 2005-307649 | | 11/2005 |
| JP | 2006219841 | A | 8/2006 |

* cited by examiner

CEMENT MORTAR PANEL WITH PRESTRESSED BIAXIAL REINFORCEMENT

CROSS REFERENCE TO RELATED APPLICATIONS

This application is a national stage application filed under 35 U.S.C. 371 of International Application No. PCT/ES2007/000706, filed Dec. 3, 2007, which claims priority from Spanish Application No. U200700993, filed May 14, 2007, and Spanish Application No. 0200702060, filed Oct. 11, 1007.

BACKGROUND OF THE DISCLOSURE

1. Field of the Invention

The present invention relates, as indicated in the title thereof, to a cement mortar panel with prestressed biaxial reinforcement, as well as to the manufacturing process thereof, which more precisely relates to a panel of the type prefabricated from cement mortar which, in the construction of buildings, is designed to close openings in the structure of a building, both the external openings, in which case the visible face thereof is textured to form the facade, and the internal openings, in which case no texture is needed on its visible face, which delimit the internal courtyards of the building.

2. Description of Related Art

The present applicant is holder of patents ES 2 220 189, U.S. Pat. No. 6,857,241, utility models ES 1 041 896, ES 1 045 543, ES 1 057 874 and ES 1 057 875 and of patent applications EP 1 203 850 and WO0104433.

All the above mentioned patents and regional and international patent applications disclose the process and/or means for the manufacture of a lightweight panel made with cement mortar which is for closing the openings in the structure of a building to form the external and internal facades thereof. The panel is of reduced thickness in the range of 2 to 6 cms and has a prestressed biaxial reinforcement. The panel is provided inserted in the mass thereof and extending out from the hidden face thereof with shaped means for anchorage to the structure of the building. The means preferably are formed by lengths of straight omega section galvanized steel sections.

The said omega type section lengths inserted in the mass of the panel have the drawback that, apart from the operation of insertion of the said omega shaped sections in the mortar and consequently the operation of maintaining them stable therein until the time when the mass of mortar is sufficiently hard at the onset of setting of the mortar to be able to rely on the stability of said omega shaped lengths being delicate and rather laborious, the fact that said omega shaped lengths project out from the hidden face of the panel causes problems of space in transportation and storage, without excluding the risk of scratches that may be caused in such situations on the visible faces thereof.

BRIEF SUMMARY OF THE DISCLOSURE

In order to overcome the abovementioned drawback, the solution has been adopted of providing the panel itself with versatile operating means allowing versatile operations to be performed therewith, either for carrying out, in principle, handling and transportation operations of, finally, for installation and anchorage thereof in the building structure.

In accordance with the above solution, there has been developed the cement mortar panel with prestressed biaxial reinforcement of the present invention. Accordingly, this cement mortar panel is formed by a slab of cement mortar having a thickness ranging from 2 to 7 cms and including a prestressed biaxial reinforcement. The reinforcement is formed by two series of prestressed cables or rods. The cables or rods are parallel and equidistant within one same series and cross each other orthogonally without being attached to one another to form a grid. The cement mortar slab is provided with means for versatile operating on the panel assembly allowing it to be handled and/or attached to the structure of a building. The said versatile operating means are occluded in the mass of cement mortar, without extending from any of the surfaces thereof and are inserted in some of the spaces between the meshes. At the same time they themselves form, on one part, means for retention thereof in the set mass of the cement mortar and, on the opposite part, anchoring means both for panel handling members and members for fixation thereof to the building structure.

One feature of the invention consists of the fact that the means for versatile operating on the cement mortar panel are embodied by plugs which are inserted in the cement mortar mass prior to its setting and are located in the inner space of the grid formed by the biaxial reinforcement, in such a way that the retaining means thereof are housed in said cement mortar mass under the prestressed reinforcement without extending to the visible face of the panel, while the anchoring means both for panel handling members and members for the fixation thereof to the building structure have the end portion thereof flush with the surface of the hidden face of the panel.

One alternative to the foregoing feature is constituted by the possibility that the means for versatile operating on the cement mortar panel are embodied by holes made in the cement mortar mass during or after the setting thereof and situated in the inner space of the reinforcement grid, in which appropriate versatile operating means are anchored or there are provided panel handling members and/or members for fixation to the building structure which are successively directly inserted in said holes.

Further features of the invention related to the implementation of the versatile operating means in the form of a plug inserted in the mass of the panel are established by the following facts:

a—the plug forming the panel versatile operating means consists of a short thick body having at one end the means for retaining it within the set mortar, while the rest forms the anchoring means.

b—the plug forming the versatile operating means is formed by a body made from a material selected from the group comprising metals, synthetic and man-made plastics, ceramic materials, cement mortars and hydraulic cements.

c—the retaining means provided in the plugs are formed by one or more shoulders extending radially from an end perimetrical portion with which the corresponding end of the plug body is limited, preferably in form of a flange.

d—the radially extending shoulder forming the retaining means is provided with arrangements of the group comprising slots and holes for the passage of at least one of the reinforcements.

e—the anchoring means provided in the plug are formed by a deep axial blind hole which is provided with internal reliefs and opens in a centre of a flat annular end surface which limits the correspond end of the plug body and which is flush with the hidden face of the panel, the internal reliefs provided in said deep axial blind hole being formed by reliefs of the group comprising screw threads, bayonet fittings and barbed surfaces.

A further feature of the invention is constituted by the fact that the anchoring means of the plug are temporally complemented by handling members which are insertable, preferably threadedly, in the deep axial blind hole thereof and which, in their inserted position project beyond the surface of the flat annular end surface limiting the corresponding end of the plug body, with a threaded end portion.

A further feature of the invention lies in the fact that the handling member temporally engageable in the deep axial blind hole of the plug anchoring means consists of a holding rod which is provided at one end thereof with a portion complementary to the anchoring means and which is preferably threaded and, at the other end comprises a gripping portion which is complementary to an automatic gripping device which allows for handling of the panel.

A further feature of the invention resides in the fact that the member for final fixation of the panel in the building structure, while remaining operable, has one end inserted in the deep axial blind hole of the plug anchoring means and another end, opposite the former, forming a threaded portion which extends from the hidden face of the panel and passes through a polygonal plate. This plate forms, on one of its sides, the seat thereof in a cradle of the building structure, at the same time as it is associated with positioning means thereof on said threaded portion allowing it to be firmly located at any point along said threaded portion to adjust the distance of the panel from the building structure.

A further feature of the invention, directly associated with the foregoing one, lies in the fact that the building structure, in which the cement mortar panel with prestressed biaxial reinforcement is installed, comprises cross member sections which, horizontally fixedly attached to uprights at one of their sides, have the opposite end to the fixed one overhanging and forming an upwardly open channeled cradle, which forms a seat for the polygonal plate incorporated in the fixation members inserted in the anchoring means of the versatile operating means.

Further features of the invention, which are associated with the foregoing two, consist of the means for positioning the polygonal plate on the threaded portion of the fixation member may be formed by arrangements of the group comprising a threaded sleeve which, being fixedly attached to the polygonal plate, rotates along said threaded portion of the fixation member or a through hole in the polygonal plate for said threaded portion in cooperation with two nuts, one on each side of the polygonal plate which rotate along said threaded portion in the sense of positioning and fixing it at a point at a set distance from the building structure.

Yet another feature of the invention is constituted by the fact that the polygonal plate forming the positioning means is seated at one of its edges on the lower side of a C-shaped section horizontally installed in the structure, at the same time as the threaded portion of the fixation member, which extends from the panel and is attached to said polygonal plate, crosses through the open space formed lengthwise between the two flanges of the said C-shaped section. In this case, the dimension of the C-shaped section is narrower than the vertical dimension of the polygonal plate in its seated position therein, while having at its upper side on the upper flange, opposite to the side on which the polygonal plate is seated, passage gaps dimensioned for the vertical insertion of the polygonal plates mounted in the panels. The purpose of this is that in the final installed position of the panel the polygonal plates are situated at points of the C-shaped section where there are no passage gaps.

A further alternative feature of the foregoing lies in the fact that the member for final fixation of the panel in the building structure, while remaining operable, consists of a screw which, retained in the building structure, may be screwed into a screw thread provided in the deep axial blind hole of the anchoring means of the plug inserted in the panel.

A further feature of the invention, associated with the handling members, consists of the fact that the said handling members formed by the support rods, at the same time as they are fixed in the axial blind holes of the plug bodies forming the anchoring means, retain a closure plate which with its Teflon-coated active surface engages the flat annular end surfaces of the plug bodies and the mortar surface forming the hidden face of the panel, encapsulating the mold.

A further feature of the invention is constituted by the fact that each of the automatic gripping devices consists of a mechanism which is of the type driven by means selected from the group formed by electric, pneumatic and hydraulic means and is provided with gripping means which are complementary to the gripping portion of the handling members. A plurality of these automatic gripping devices is incorporated in a horizontal frame which is provided with vertical movement and spacers which limit its seating on the mold while they are located in the frame in accordance with the positioning contemplated for the insertion of the plugs in the fresh mass of the cement mortar which will form the panel.

A further feature of the invention lies in the fact that the surface of the mold on which the cement mortar mass for forming the visible face of the panel rests comprises a bottom wall which is formed by a Teflon-coated sheet which may be provided with a defined pattern on its surface and side walls against which the said mortar mass must be applied to form the edges of the panel and which are formed by Teflon-coated plates having no defined pattern.

Finally, on the other hand, the invention comprises a process for correctly carrying out the manufacture of the panel having prestressed biaxial reinforcement of the invention, which process, using substantially flat metal molds having a bottom wall and side molding walls and a closure cover, consists essentially of the following steps:

a. providing in each of the molds a biaxially stressed reinforcement formed by two series of steel cables or rods, in each of which the cables or rods are mutually coplanar, parallel and equidistant, with the orthogonal superpositioning thereof forming a grid.
b. pouring a mass of cement mortar in the mold and leveling its thickness.
c. inserting in spaces of the grid a plurality of plugs, as the versatile operating means which, after the mortar has set, are provided with panel handling and/or fixation members.
d. closing the upper surface of the mold with a mold encapsulating cover.
e. transferring the closed mold to a modular tunnel kiln in which the mortar is pre-cured.
f. progressively removing the molds from the tunnel kiln and stripping the pre-cured panel from each of them.
g. post-curing the pre-cured panels, and
h. quality control and trimming the external branches of the reinforcement elements.

Further features of the process of the invention consist of the following conditions:

i. the pre-curing step in the modular tunnel kiln is effected by maintaining the mold with the mortar, the reinforcement and the versatile plugs at a temperature of 50° C. for 7 hours.
ii. the post-curing step in modular tunnel kiln is effected by maintaining the pre-cured panel at a temperature of 50° C. and humidity of 95% for 48 hours.
iii. The bottom wall, the side walls and the mold closure cover are coated with a layer of Teflon on their surfaces which contact with the cement mortar mass.

BRIEF DESCRIPTION OF THE SEVERAL VIEWS OF THE DRAWINGS

To facilitate the understanding of the foregoing ideas, there are described hereinbelow some preferred embodiments of the object of the invention, wherein there are brought together the manufacturing process and the product thereby produced, consisting of a cement mortar panel with prestressed biaxial reinforcement, with reference to the accompanying drawings which, in view of their merely illustrative nature, do not affect the scope of the invention. In the drawings.

DETAILED DESCRIPTION OF THE DISCLOSURE

Figure 1:
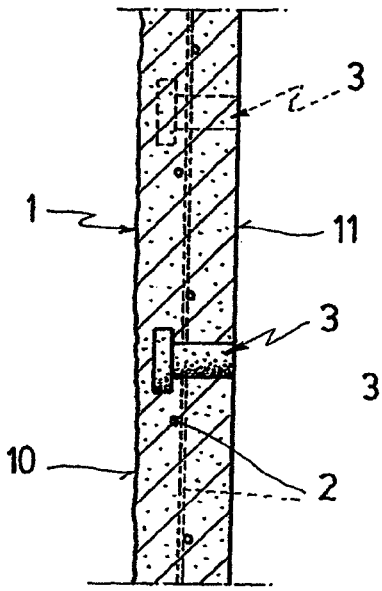
FIG. 1 is a cross sectional view of a portion of a cement mortar panel with prestressed biaxial reinforcement, showing one of the versatile operating means of the invention.
Figure 2:
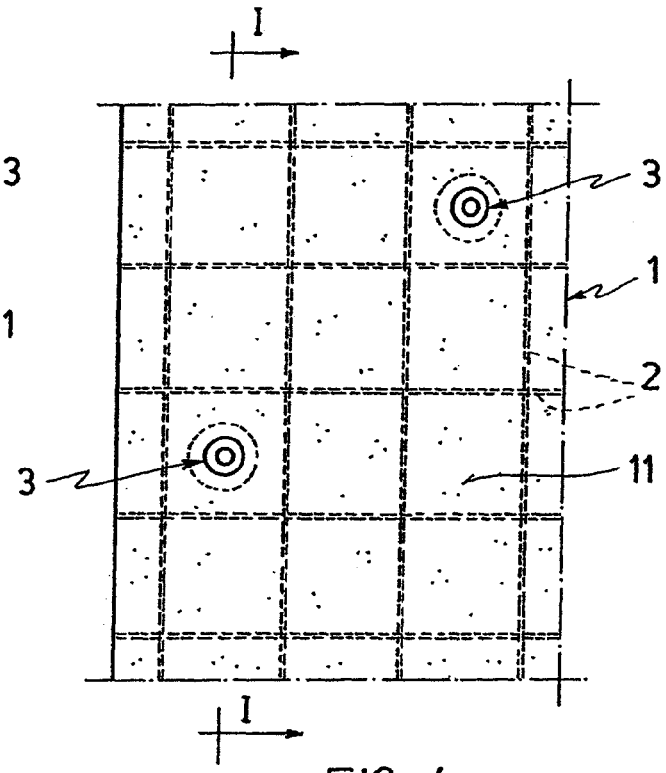
FIG. 2 is a schematic view of the distribution of the versatile operating means in a cement mortar panel with prestressed biaxial reinforcement relative to said prestressed biaxial reinforcement.

FIG. 1 shows a small fragment of a panel 1 of cement mortar with prestressed biaxial reinforcement 2 incorporating versatile operating means therefor in a building structure which means are formed, in a preferred embodiment, by a plug 3 which is located in said panel 1 as shown in FIG. 2, where the arrangement thereof in the grid formed by the prestressed biaxial reinforcements 2 is shown.

Figure 3:
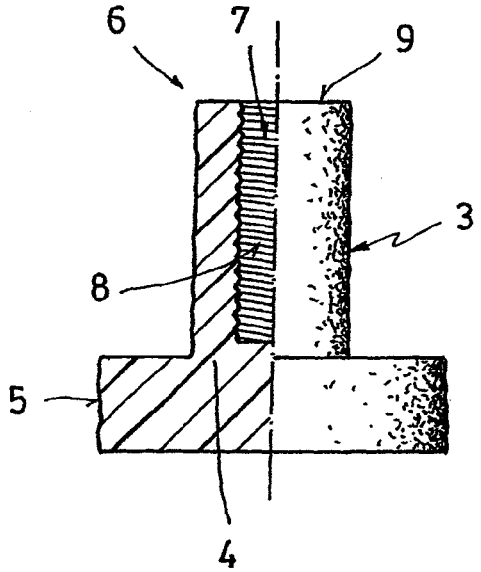
FIG. 3 is partly sectional elevation view of a plug forming one embodiment of the versatile operating means which, according to the invention, have been adopted for the handling and attachment of a cement mortar panel with prestressed biaxial reinforcement to a building structure.

FIG. 3 shows in detail a preferred embodiment of the versatile operating means of the panel 1 which are formed by said plug 3. This consists of a short, thick body portion 4 having at one end means 5 for retaining it in the hardened mortar of the panel 1. The means 5 are formed by an outwardly extending polygonal shoulder of star or other shape and, in the present case having the form of a flange, while in the rest of the body portion 4 there are the anchoring means 6 formed by a deep axial blind hole 7, having internal reliefs 8 and which opens out axially and centrally of a flat annular end surface 9 which limits the corresponding end of the body portion 4 of the plug 3 and lies flush with the hidden face of the panel 1, without projecting therefrom, as shown in FIG. 1.

Figure 5:
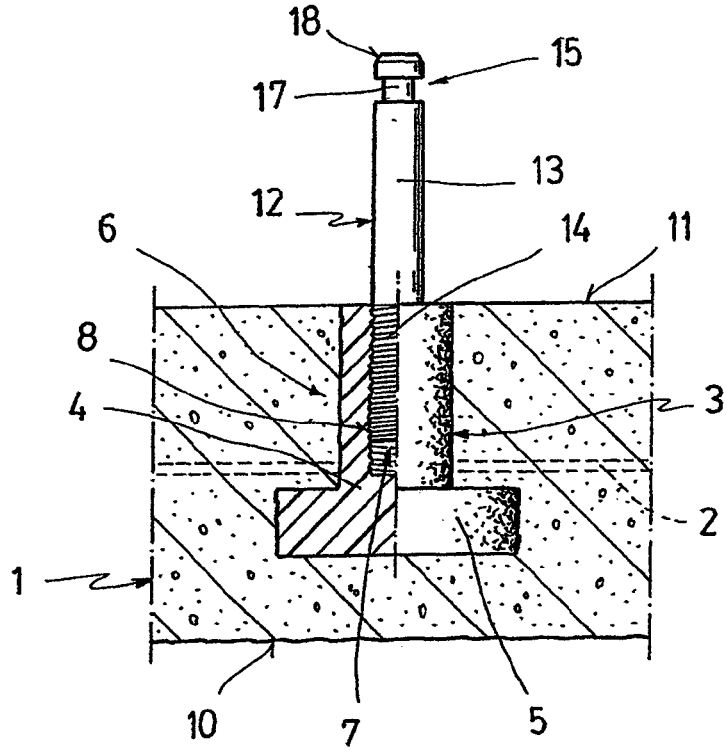
FIG. 5 is a partly sectional elevation view of the plug according to the embodiment of the versatile operating means shown in FIG. 3 after it has been occluded in a cement mortar panel with prestressed biaxial reinforcement and the embodiment of the handling member shown in FIG. 4 has been engaged therewith.

With regard to the above mentioned versatile operating means for the panel 1, the retaining means 5, as shown in FIG. 5, are housed in the mortar mass before it hardens and within the grid formed by the prestressed biaxial reinforcements 2, under said reinforcements and without reaching the visible face 10 of the panel 1, while the anchoring means 6 to a building structure have a portion thereof formed by the flat annular end surface 9 which lies flush with the hidden face 11 of the panel 1.

The internal reliefs 8 provided in the deep axial blind hole 7 of the plugs 3 forming the attachment means 6 are of the group comprising screw threads such as those shown in FIG. 3, bayonet fittings and barbed surfaces, not shown in the drawings.

Figure 4:
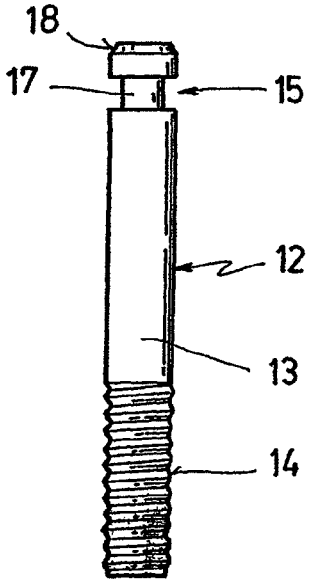
FIG. 4 is a side elevation view of an embodiment of a handling member for the cement mortar panel with prestressed biaxial reinforcement which, in engagement with the versatile operating means, allows the handling and installation of said mortar panel with prestressed biaxial reinforcement during its manufacture and attachment to the resistant structure of a building.

As shown in FIGS. 4 and 5, the anchoring means of the plugs 3 are complemented by handling members 12 which may be engaged with the deep axial blind hole 7 thereof and project outwardly in the fixed position thereof from the surface of the flat annular end surface 9 limiting the corresponding end of the body portion 4 of the plug 3.

Figure 9:
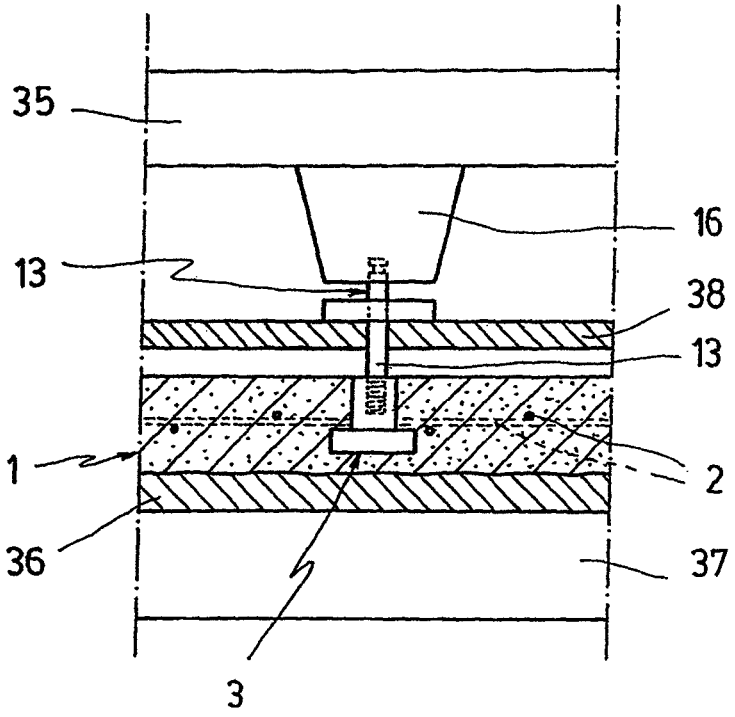
FIG. 9 is a schematic view of a group of members allowing for handling of the cement mortar panel with prestressed biaxial reinforcement both in its preparation and molding process and in the removal thereof from the mold.

One possible embodiment of the said handling member 12 consists of an anchoring rod 13 which is provided at one end thereof with an anchoring portion 14 which is complementary to the anchoring means 6 of the plug 3, and at the other end it comprises a gripping arrangement 15 with which an automatic gripping device 16 may engage as shown in FIG. 9.

According to a first stage of use of the versatile operating means embodied by the plug 3, the handling member 12 may be screwed in the screw thread 8 of the deep axial blind hole 7 of said plug 3 and consists of a support rod 13 which, as shown in FIGS. 4 and 5, has at one end a fixation portion 14, which in this case is threaded and complementary to the said screw thread 8 of the plug 3 and at the other end it comprises a gripping arrangement 15, formed by a throat 17 and a chamfer 18, with which the automatic gripping device 16 may engage.

Figure 6:
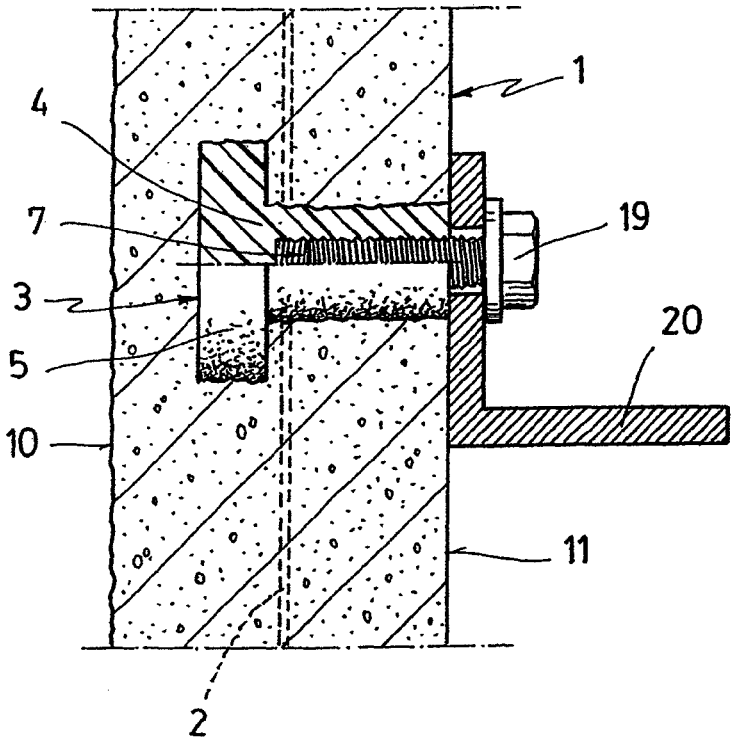
FIG. 6 is a sectional view of an anchoring point of a cement mortar panel with prestressed biaxial reinforcement in a metal section of a resistant structure of a building.

In a second, and normally definitive, stage of use of the said versatile operating means embodied by the plug 3, as shown in FIG. 6, the handling member 12 engageable with the deep axial blind hole 7 of a plug 3 is replaced by a fixation member which is of a type capable of being screwed into the screw thread 8 of said plug 3 and consists of a screw 19 for fixation of the panel 1 to a section 20 of the building structure. The screw 19 may be accompanied by retaining washers or other security means.

Figure 7:
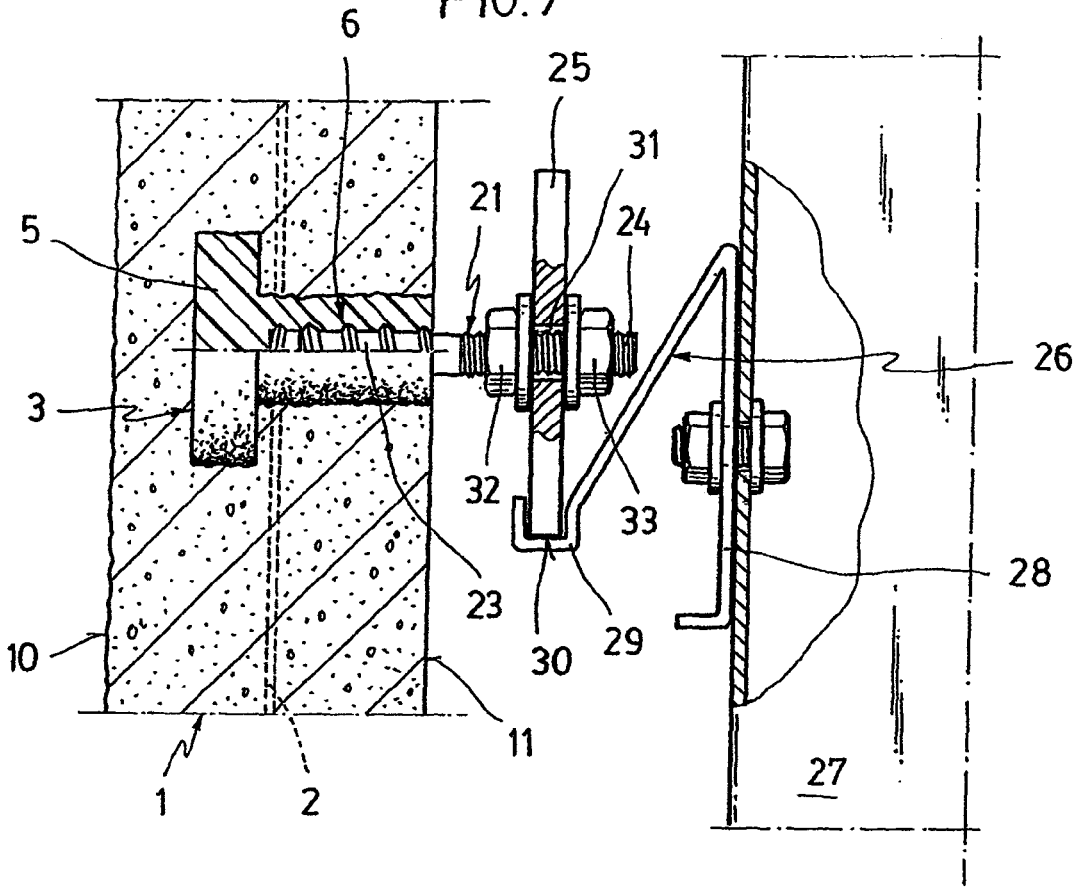
FIG. 7 is a partly sectional elevation view of an embodiment of a member for final fixation of a panel to the building structure which is formed by a polygonal plate and includes positioning means therefor constituted by two nuts.

In FIG. 7 there is shown a preferred embodiment of a final fixation member 21 for the panel 1 to the structure 22 of the building which, while remaining removable, has one end 23 inserted in the deep axial blind hole 7 of the anchoring means 6 of the plug 3 and the other end 24, opposite to the former, forming a threaded portion which projects from the hidden face 11 of the panel 1 and passes through a polygonal plate 25 which forms the seat therefor in the building structure 22.

The building structure 22 is formed mainly by transverse sections 26 which are fixedly attached horizontally to uprights 27 by one of their edges 28*f* while at their opposite edge they form an upwardly open channel-shaped cradle 29. Such cradle 29 forms a seat for one edge 30 of the polygonal plate 25 which is attached to the final fixation members 21 inserted in the anchoring means 6 of the versatile operating means formed by the plug 3. The polygonal plate 25 is seated by the edge 30 of one of its sides in the cradle 29, at the same time as it is associated with positioning means therefor on said threaded portion of the end 24 allowing it to be fixedly located at any point along said threaded portion to adjust the distance from the panel 1 to the building structure 22 and thereby assure that the visible faces 10 of the facade panels are coplanar.

Figure 8:
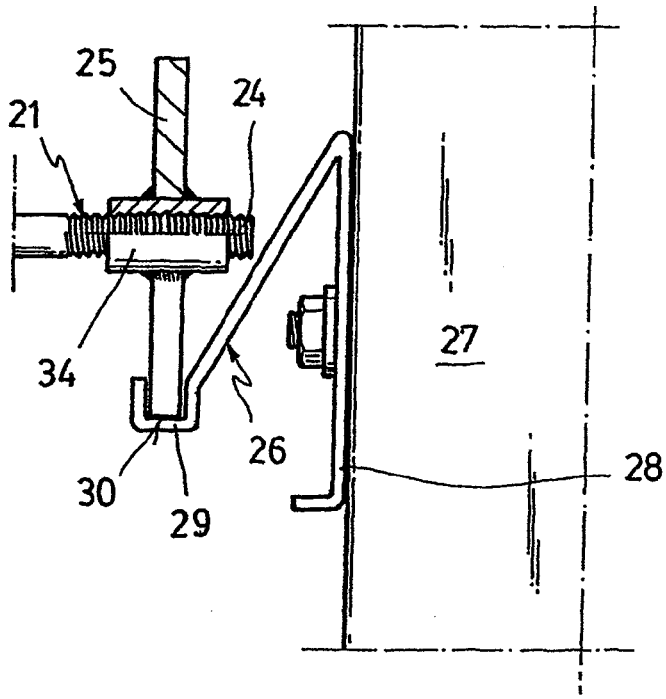
FIG. 8 is a partly sectional elevation view of a detail of another embodiment of a member for final fixation of a panel to the building structure which is formed by a polygonal plate and includes positioning means therefor constituted by a threaded sleeve.

As shown in FIGS. 7 and 8, the positioning means for the polygonal plate 25 on the threaded portion of the end 24 of the final fixation member 21 are formed, as shown in FIG. 7, by arrangements of the group comprising that of a through hole 31 in the polygonal plate 25 for the passage of said threaded portion of the end 24 in cooperation with two nuts 32 and 33, one on each side of the polygonal plate 25 and which are rotatably moved along said threaded portion of the end 24 in the sense of locating and fixing the plate in a point at a certain distance from the building structure 22, while in FIG. 8, the said positioning means are formed by a threaded sleeve 34 which is integral with the polygonal plate 25 and is rotatably moved along said threaded portion of the end 24 of the final fixation member 21.

In FIG. 9 there is shown the positioning of the automatic gripping device 16 relative to: a mobile support frame 35; the handling members 12, formed by the support rods 13 after being fixed in the axial blind holes 7 of the body portions 4 of the plugs 3; the panel 1, with the prestressed biaxial reinforcement 2; a Teflon-coated base plate 36 of the mold which, having a visible texture appropriate for a facade forms the visible face 10 of the panel 1, with the mold holder 37; and the fact that it retains together with the said body portions 4 of the plugs 3 a closure plate 38 whose contact surface with the said body portions 4 of the plugs 3 and with the mortar of the hidden face 11 of the panel 1 is Teflon-coated.

Figure 10:
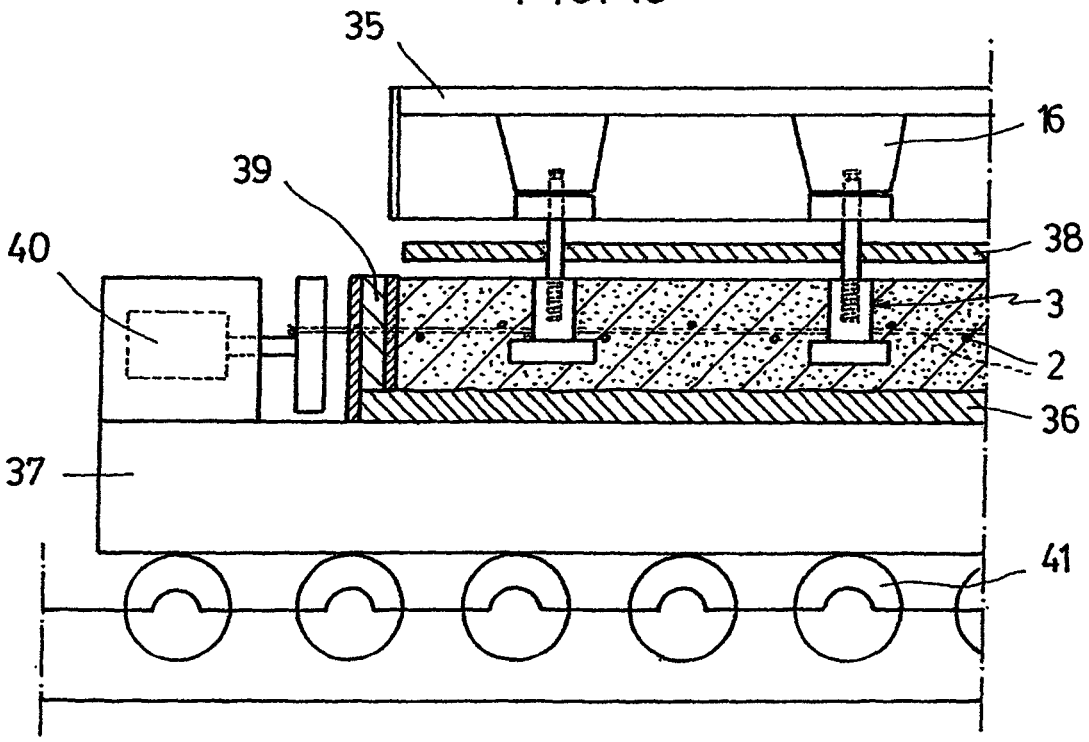
FIG. 10, similarly to the previous figure, shows the group of members accompanied by certain details situated in functional parts of some of them.

As shown in FIG. 10, walls 39 or surfaces of the sides of the mold against which the mortar mass for forming the edges of the panel 1 must be applied, like the Teflon-coated bottom wall 36 and closure 38 plates, are formed by Teflon-coated plates through which the prestressed biaxial reinforcements pass. The latter are stressed by hydraulic devices 40 mounted on the mold holder 37 which, in turn, is located on rotary rollers 41.

Figure 11:
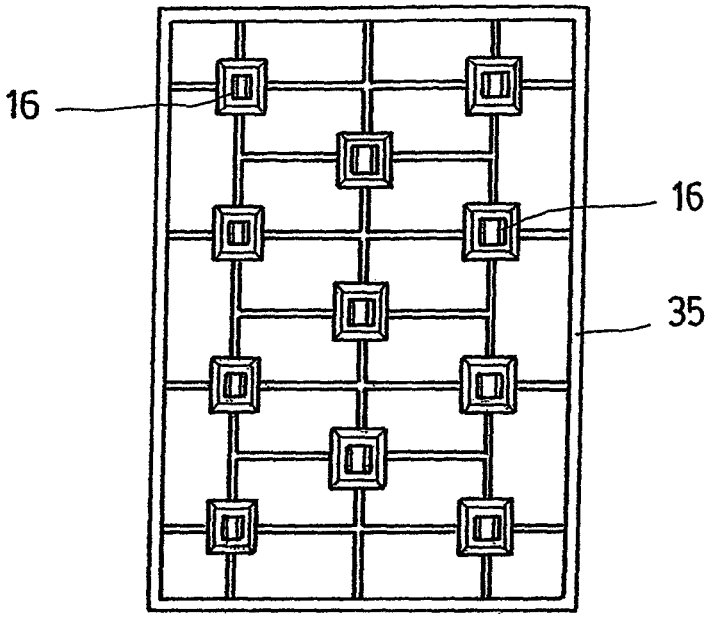
FIG. 11 is a top plan view of the arrangement of the members of FIGS. 10 and 11 in an operative frame.
Figure 12:
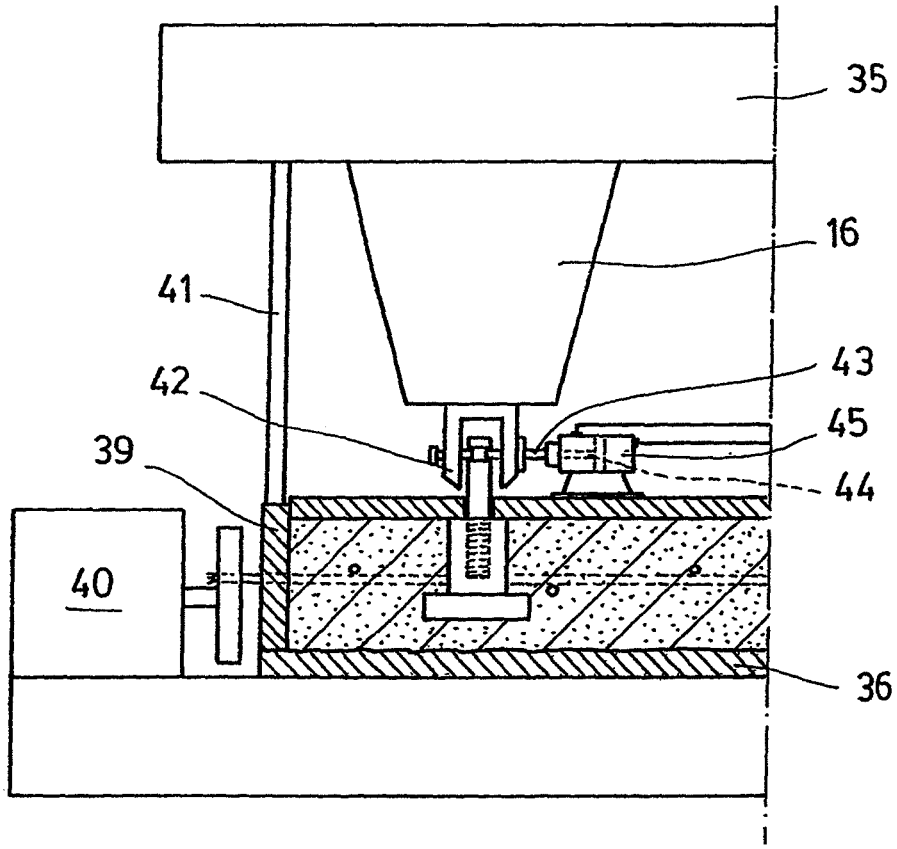
FIG. 12 shows, like the cases of FIGS. 10 and 11, a specific embodiment of an automatic gripping device which allows action to be taken on the versatile operating means in the handling of the cement mortar panel with prestressed biaxial reinforcement.

In FIG. 11 there is shown a possible embodiment of support for the horizontal mobile frame 35 capable of vertical movement and provided with a plurality of automatic gripping devices 16 which are situated in accordance with the positioning contemplated for the plugs 3 in the panel 1. FIG. 12, which is substantially similar to FIGS. 9 and 10, shows that the mobile support frame 35 for the automatic gripping devices 16 is provided with spacers 41 which limit its seating on the mold, at the same time as it shows one possibility of operation of one embodiment of an automatic gripping device 16 which is provided with an automatic gripping device 42 driven by the rod 43 of a piston 44 sliding in a fluid-operated cylinder 45.

Figure 13:
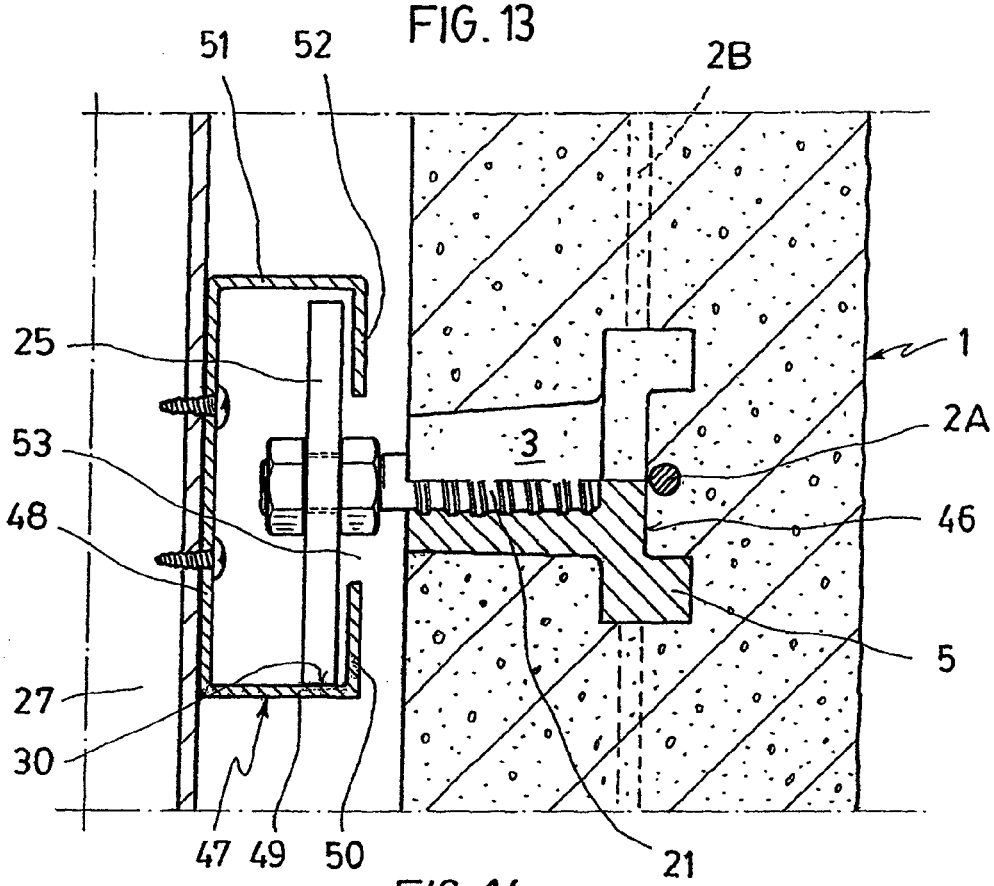
FIG. 13 is a partly sectional view of a detail of the assembly of a panel in a C-shaped section of the structure of a building by way of fixation means formed by a polygonal plate which is associated with a plug having an open passage for one of the biaxial reinforcement members.

In FIG. 13 there is shown, on the one hand, a panel 1 with its biaxial reinforcements 2 and a plug 3, arranged relative to one another in such a way that one of the members 2A of the biaxial reinforcements 2 extends in a slot 46 provided in the head formed by the retaining means 5 of the plug 3 in the panel 1, while on the other hand it shows the assembly of a polygonal plate 25 to the final fixation member 21 and the seating thereof by its edge 30 in a C-shaped section 47 which is horizontally attached to an upright 27. The said C-shaped section has a base wall 48, a lower side 49 followed by a lower flange 50 and an upper side 51 followed by an upper flange 52, there being between the lower flange 50 and the upper flange 52 an open longitudinal space 53 through which said fixation member 21 extends.

Figure 14:
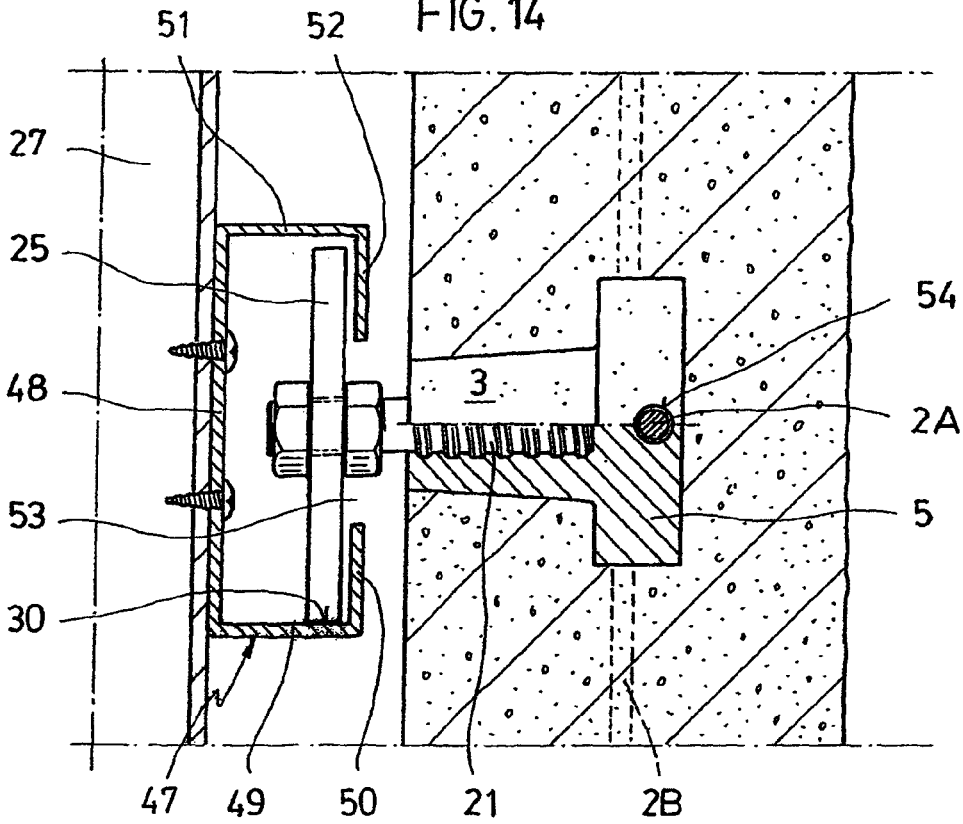
FIG. 14 shows, like the previous case, the members included in FIG. 13, with the exception that the plug has an enclosed passage for one of the biaxial reinforcement members.

In FIG. 14 there is shown the same members as in FIG. 13, although the member 2A of the biaxial reinforcements 2 extends through a hole 54 diametrically formed in the head forming the retaining means 5 of the plug 3 in the panel 1. It will be seen in both figures that a member 2B of the biaxial reinforcements 2 perpendicular to the member 2A extends in the vicinity of said head without engaging it. Nevertheless, it is contemplated that said member 2B also may engage said head, either along a slot perpendicular to the slot 46 provided for the member 2A, or through a hole perpendicular to the hole 54 for the member 2A.

Figure 15:
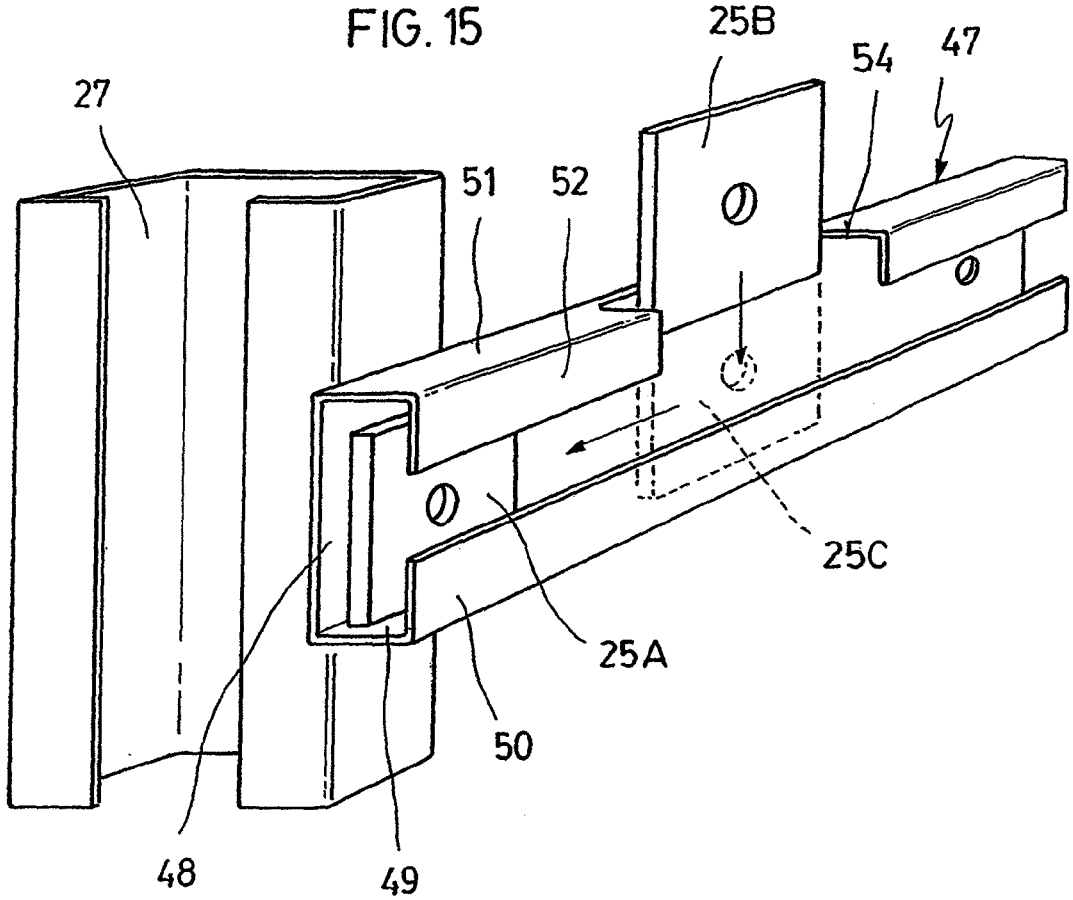
FIG. 15 is a perspective view of a detail of a building structure in which the horizontal support section for the panels is formed by a C-shaped section having gaps for vertical insertion of the polygonal plates of the fixation means.

In FIG. 15 there is to be seen an upright 27 and a C-shaped section 47 horizontally attached to the upright 27. The C-shaped section 47 has passage gaps 54 which affect portions adjoining the upper side 51 and the upper flange 52 and which are dimensioned to allow the vertical insertion of the polygonal plates 25A and 25D for final fixation of the panels 1. These polygonal plates 25A and 25B have been shown in the drawings as independent from the panels to facilitate the understanding of said passage gaps 54.

In the foregoing figure it is to be noted that the polygonal plate 25A is capable of being inserted vertically in the C-shaped section 47 thanks to the passage gap 54 to reach the position shown in phantom line of the polygonal plate 25C, after which this polygonal plate 25C is moved to the left of the drawing to reach the position of the polygonal plate 25A. In this position the polygonal plate 25A can no longer move vertically, thereby ensuring the positioning of the panel 1.

Figure 16:
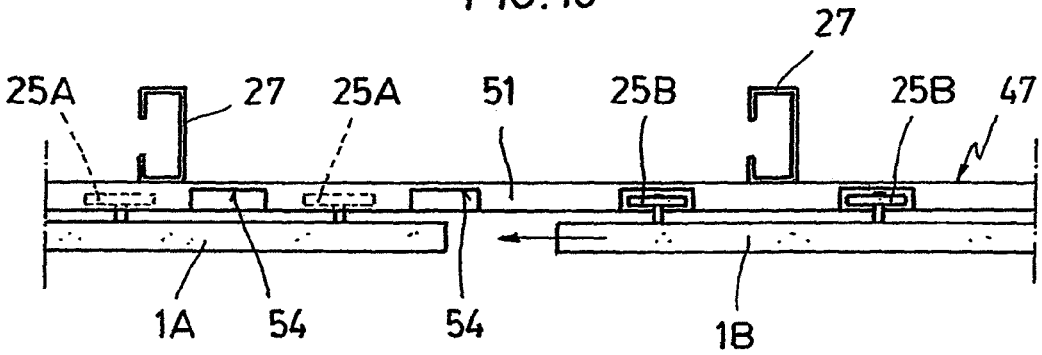
FIG. 16 is a top elevation view of a C-shaped section having gaps in which; at the left hand side, a panel has been installed while at the right hand side a panel is shown in the process of insertion of the polygonal plates.

In FIG. 16 there is shown the final positioning of a panel 1A, in which its polygonal plates 25A are blocked in the C-shaped section 47 and spaced from the passage gaps 54, while the panel 1B is being inserted in the C-shaped section 47, prior to being moved to abut panel 1A.

The manufacturing process of the present cement mortar panel with prestressed biaxial reinforcement is achieved by molding of the cement mortar in metal molds which may be arranged with one of the major dimensions thereof in a vertical position or with the two major dimensions in a horizontal position. The horizontal position is preferably adopted for the manufacture of flat surfaced panels and the vertical position for the manufacture of panels having a curved, irregular or mixed surface.

The appropriate molds for the said molding operation are made from metallic materials, especially steel, and are formed by a lower base plate for making the visible face of the panel, side walls for forming the panel edges and a closure cover for encapsulating the mold to avoid evaporation of the water from the mortar in the setting stage.

The metal base plate may be smooth and support a sheet of synthetic or other material with an ornamental texture to embellish the visible face of the panel, or, this metal base plate may be directly provided with the said ornamental texture. In all cases, it is highly desirable that the active surface of the plate is covered with a coating of Teflon.

In turn, the side walls and the closure cover have no type of texture, since the surfaces molded by them are hidden in the building, but it is desirable that their active surfaces which contact the cement mortar or are facing it are covered with a layer of Teflon.

Complementarily, the molds will be mounted in mold holder frames which incorporate the prestressing means for the biaxial reinforcement which will be hidden in the cement mortar mass of the panel, forming an assembly which is moved for insertion in the tunnels for pre-curing and post-curing the cement mortar and for stripping the panel from the mold after the mortar has set.

Figure 17:
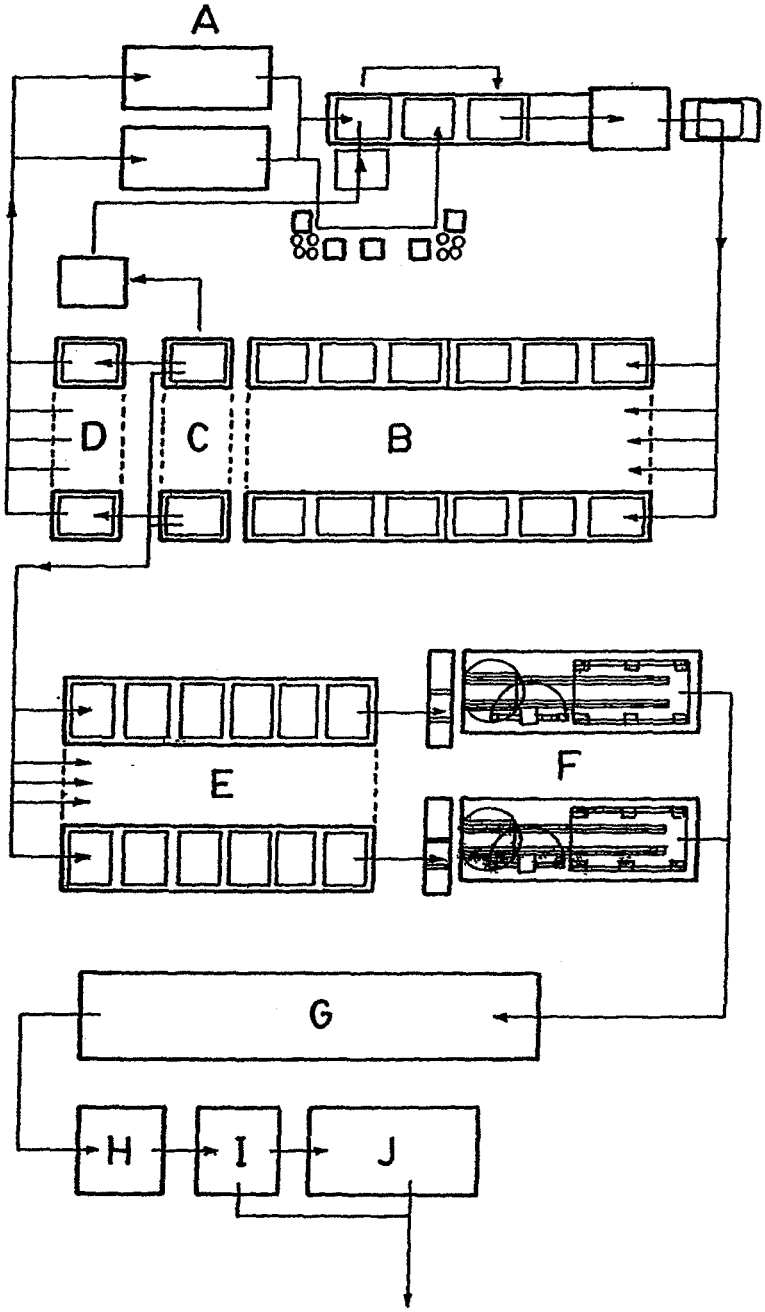
FIG. 17 is a schematic view of the layout of the manufacturing means for the cement mortar panels of the invention according to their location in a hypothetical industrial plant for their preparation.

With the molds as succinctly described above, the steps of the process of the invention for the manufacture of the cement mortar panels with prestressed biaxial reinforcement are as listed below and shown in FIG. 17:

a.—placing in each of the molds A a biaxially stressed reinforcement formed by two series of steel cables or rods, in each of which series the cables or rods are coplanar, parallel and equidistant one from another, with the orthogonal overlaying of them forming a grid.

b.—pouring a mass of cement mortar A1 in the mold and leveling the thickness.

c.—inserting in spaces of the grid A2, as versatile operating means, a plurality of plugs which, once the cement mortar has set, are provided either with handling members or panel fixation members.

d.—closing the upper surface of the mold A3 with a mold encapsulating cover to avoid evaporation of the water from the cement mortar during the pre-curing and post-curing steps of the set mortar.

e—transferring the closed mold to a modular tunnel kiln B in which the cement mortar is pre-cured.

f.—progressively removing the molds from the tunnel kiln B, mold stripping C of the panel pre-cured in each of them and cleaning D of the molds for reuse.

g.—post-curing of the pre-cured panels in tunnel kilns E and h.—quality control F and trimming the external portions of the prestressed biaxial reinforcement.

i.—drying in store G, surface H, cleaning I and painting J.

The pre-curing step in modular tunnel kiln is effected by holding the mold with the cement mortar, the reinforcement and the plugs of the versatile operating means at a temperature of 50° C. for 7 hours, while the post-curing step in modular tunnel kiln is effected by holding the panel stripped from the mold at the end of pre-curing at a temperature of 50° C. and 95% humidity for 48 hours.

The invention claimed is:

1. A prefabricated cement mortar panel with prestressed biaxial reinforcement, wherein:

said cement mortar panel is formed by a slab of cement mortar;

said cement mortar slab has a thickness ranging from 2 to 7 cm and includes a prestressed biaxial reinforcement, said prestressed biaxial reinforcement being formed by two series of prestressed cables or rods which are parallel and equidistant within one of said two series, said two series of prestressed cables or rods crossing each other orthogonally to form a grid, without said cables or rods being attached to one another;

said cement mortar slab is provided with a versatile operating portion for handling the cement mortar panel and for fixing it to a building structure;

said versatile operating portion comprising plugs, said plugs being inserted in at least a portion of one or more spaces in the grid and occluded in the mass of the cement mortar slab without extending from any surfaces of said slab;

a first segment of each of said plugs forms a retention portion for retaining said plugs in the set mass of the cement mortar; and a second segment of each of said plugs forms an anchoring portion for temporally anchoring at least one of panel handling members for handling the panel before fixing it to a building structure or panel fixing members for fixing the panel to said building structure, said panel handling members being formed by rods temporally anchored to said anchoring portion of said plugs via an anchoring element of said rods, said anchoring element being complementary to said anchoring portion of said plugs, such that said rods project outwardly beyond a face surface of said cement mortar slab, said rods being further provided with, at an end opposing said anchoring element thereof, a gripping arrangement, said gripping arrangement comprising a transverse throat formed in the vicinity of an end of each of said rods and a chamfer formed in an edge of said end of each of said rods.

2. The prefabricated cement mortar panel of claim 1, wherein said retention portions of said plugs are located in the inner space of said grid formed by said two series of prestressed cables or rods, in such a way that said retention portions of said plugs are housed in said mass of said cement mortar slab below said prestressed cables or rods and without extending to the face of said cement mortar slab.

3. The prefabricated cement mortar panel of claim 1, wherein said retention portion of each of said plugs is formed by a flange that extends radially outwards from the surface of said plug so as to form an end of said plug.

4. The prefabricated cement mortar panel of claim 1, wherein:

said anchoring portion of each of said plugs is formed by an axial blind hole which is provided with an internal arrangement belonging to the group consisting of: threads, bayonet fittings, and barbed surfaces;

said axial blind hole opens in the center of a flat annular surface at the end of said plug; and said flat annular surface is flush with the face of said cement mortar slab.

5. The prefabricated cement mortar panel of claim 3, wherein:

said flange, which forms said retention portion of said plug, is provided with a passage for at least one of said prestressed cables or rods; and said passage is formed by an arrangement of at least one of slots or holes.

6. The prefabricated cement mortar panel of claim 1, wherein:

said panel is fixed to said building structure via a transverse section that is fixedly attached to said building structure;

said panel fixing members are anchored to said anchoring portion of said plugs;

said panel fixing members are provided, at one end, with an anchoring element that is complementary to said anchoring portion of said plugs, and at the other end, with a threaded portion which extends from the face of said cement mortar slab and passes through a polygonal plate;

one side of said polygonal plate forms a seat by which said polygonal plate seats on said transverse section; and said polygonal plate is associated with positioning portions configured for firmly positioning said polygonal plate at any point along said threaded portion to adjust the distance of the panel from the building structure.

7. The prefabricated cement mortar panel of claim 6, wherein:

said transverse section fixedly attached to said building structure comprises a C-shaped section, said C-shaped section having a base wall, a lower side followed by a lower flange, and an upper side followed by an upper flange, there being an open longitudinal space between said lower and upper flanges;

said polygonal plate seats via said one of its sides on said lower side of said C-shaped section; and said threaded portion of the panel fixing fixation member passes through said open space between the two flanges of said C-shaped section.

8. The prefabricated cement mortar panel of claim 7, wherein said C-shaped section has a width smaller than the vertical dimension of said polygonal plate.

9. The prefabricated cement mortar panel of claim 7, wherein said C-shaped section has on its upper side and on its upper flange, opposite to its lower side on which said polygonal plate seats via one of its sides, at least one passage gap dimensioned for the vertical insertion of said polygonal plates.

10. The prefabricated cement mortar panel of claim 9, wherein, in the final installed position of said panel, said polygonal plate is situated at a point of said C-shaped section where said at least one passage gap is not present.

11. The prefabricated cement mortar panel of claim 6, wherein said transverse section comprises a first side fixedly attached to said building structure and a second and opposing side in cantilever relative to said building structure so as to form an upwardly open channel-shaped cradle upon which said polygonal plate seats via said one of its sides.

* * * * *

UNITED STATES PATENT AND TRADEMARK OFFICE

CERTIFICATE OF CORRECTION

PATENT NO. : 8,640,399 B2
APPLICATION NO. : 12/600165
DATED : February 4, 2014
INVENTOR(S) : Fradera Pellicer It is certified that error appears in the above-identified patent and that said Letters Patent is hereby corrected as shown below:

In the claims:

Column 12,
Line 6, "panel fixing fixation member" should read --panel fixing member--.

Signed and Sealed this
Tenth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,640,399 B2
APPLICATION NO. : 12/600165
DATED : February 4, 2014
INVENTOR(S) : Carlos Fradera Pellicer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1028 days.

Signed and Sealed this
Twenty-second Day of September, 2015

Michelle K. Lee

Michelle K. Lee
*Director of the United States Patent and Trademark Office*